US005885154A

United States Patent [19]

Napadow et al.

[11] Patent Number: 5,885,154

[45] Date of Patent: Mar. 23, 1999

[54] AIR SUPPLY MEANS FOR A CONTROLLED ENVIRONMENT ROOM

[76] Inventors: Michael F. Napadow, 3N427 Willow, Elmhurst, Ill. 60126; Thomas L. Rowe, 24253 Marble Rd. —Box 304, Channahon, Ill. 60410

[21] Appl. No.: 877,218

[22] Filed: Jun. 17, 1997

[51] Int. Cl.[6] ..... F24F 13/072

[52] U.S. Cl. ..... 454/301; 454/52

[58] Field of Search ..... 454/52, 187, 301, 454/303, 304

[56] References Cited

U.S. PATENT DOCUMENTS

| | | | |
|---|---|---|---|
| 2,734,446 | 2/1956 | O'Day . | |
| 3,088,392 | 5/1963 | Egan | 454/303 |
| 3,202,077 | 8/1965 | Lee | 454/301 |
| 3,352,076 | 11/1967 | Jones | 454/301 X |
| 3,590,546 | 7/1971 | Lambert | 454/301 X |
| 3,601,033 | 8/1971 | Lambert . | |
| 3,685,235 | 8/1972 | Lang . | |
| 3,742,674 | 7/1973 | Lang . | |
| 3,929,285 | 12/1975 | Daugherty, Jr. . | |
| 4,898,087 | 2/1990 | Fitzner et al. . | |
| 5,029,518 | 7/1991 | Austin . | |
| 5,417,610 | 5/1995 | Spransky . | |

FOREIGN PATENT DOCUMENTS

| | | | |
|---|---|---|---|
| 500431 | 1/1976 | United Kingdom | 454/301 |

OTHER PUBLICATIONS

Liberto, N., "Designing a powder–application Room: Why? How?", Powder Coating, Aug. 1993.

Bailey, J.M., "Powder Comes Full Cycle at Trek," Industrial Paint & Powder, Sep. 1996.

*Primary Examiner*—Harold Joyce

*Attorney, Agent, or Firm*—Gerlach & O'Brien

[57] ABSTRACT

A controlled environment room encompassing a room space is provided with air supply structure which includes a room ceiling surmounting the room space, a top closure disposed above the ceiling and spaced apart from the ceiling to form a plenum chamber therewith, and an array of steel joists extending between and constructed and arranged to support the ceiling and the closure, the joists each including a pair of spaced apart chords which are components of the ceiling and are constructed and arranged to support the ceiling, the chords defining between them elongate slots extending through the ceiling, the slots providing air passageways extending from the plenum chamber to the room space for conducting pressurized air from the plenum chamber to the room space.

9 Claims, 4 Drawing Sheets

FIG. 3
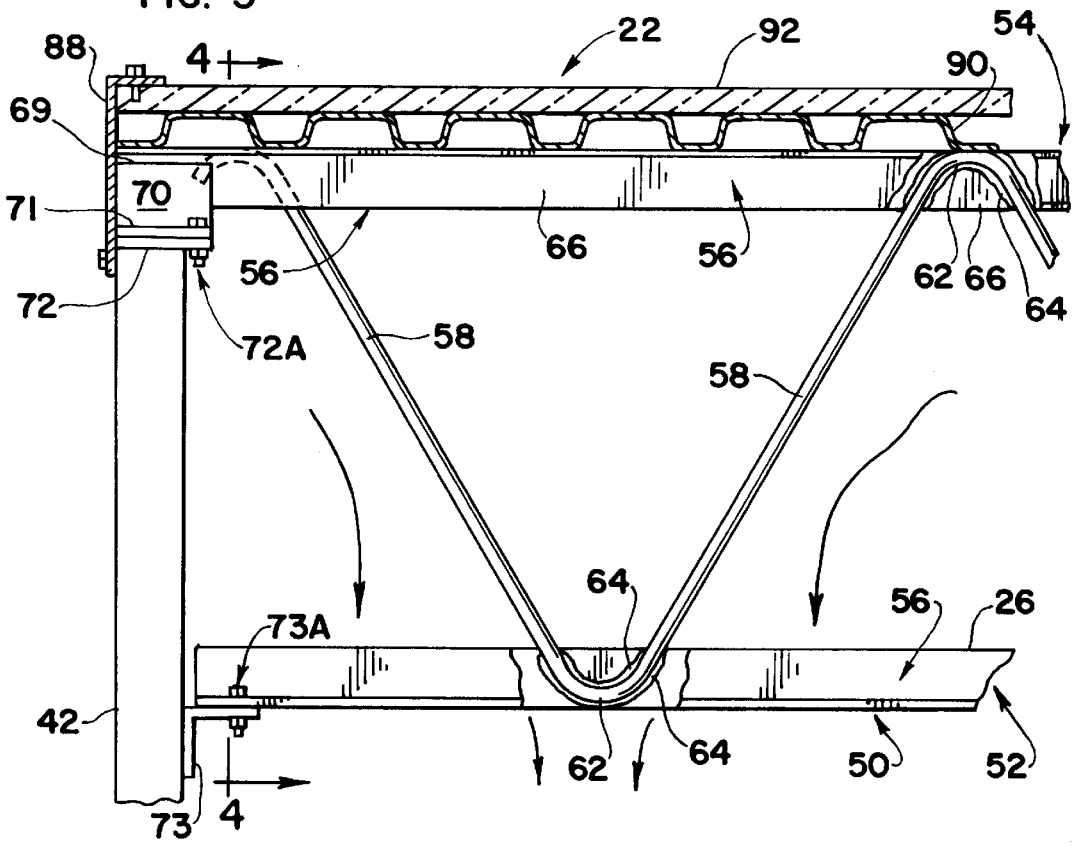
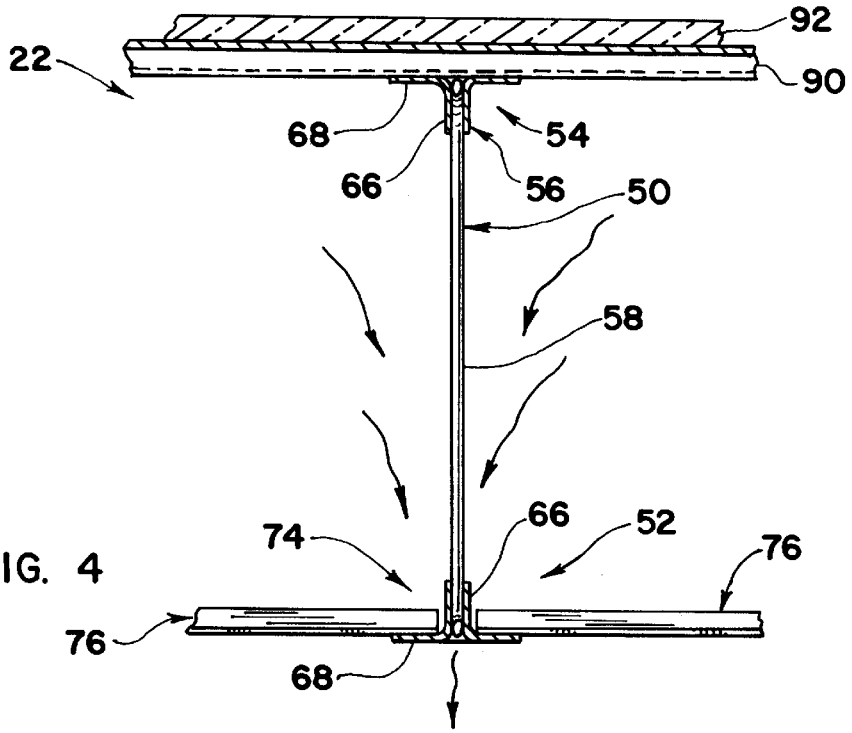
FIG. 4

AIR SUPPLY MEANS FOR A CONTROLLED ENVIRONMENT ROOM

This invention relates to controlled environment rooms, particularly, to air supply means therefor. More particularly, the invention relates to air supply means for powder coating rooms.

BACKGROUND OF THE INVENTION

Controlled environment or environmental rooms find important use in powder application processees. Thus, isolation of a process from a plant environment can make the difference between success and failure. Contaminants in the plant environment can be deposited on the work being coated. A powder application room provides optimal conditions for powder coating. (See article by Nick Liberto, "Designing a powder-application room: Why? How?", in *POWDER COATING*, August, 1993) It is important to control temperature and humidity, with humidity being important to the control of the electrostatic charge. (See article by Jane M. Bailey, "Powder Comes Full Cycle at Trek," in *INDUSTRIAL PAINT & POWDER*, September, 1996).

A controlled environment room may be constructed or erected within an industrial plant as a stand-alone room, in the room space of which temperature, humidity, and particle contaminants are closely controlled. The size of the room may vary widely, to accommodate one or more powder coating booths, and, as desired, to accommodate pretreatment and curing operations. Access may be provided for forklift trucks and parts conveyors. Return or recycled air and makeup air are filtered, to remove particles as small as two microns. The air is conditioned to provide typically a room environment of 40–70 percent humidity and 60°–80° F. room temperature for the sensitive powder coating operations.

Current systems result in variations in the velocity and the distribution of the air supplied to the room space for maintaining the desired room environment, and also involve design, material, equipment, and installation complexities and costs, which it is desired to reduce.

SUMMARY OF THE INVENTION

An important object of the invention is to provide air supply means or structure for a controlled environment room that reduce the variations in the velocity and the distribution of the air supplied to the room space for maintaining a desired room environment.

Another important object is to provide air supply means for a controlled environment room that simplify and reduce the design, material, equipment, and installation complexities and costs associated therewith.

A more particular object is to provide a controlled environment powder coating or application room having air supply means that accomplish the foregoing objects.

An additional object is to provide air supply means that accomplish the foregoing objects and provide a dual purpose superstructure that is structurally advantageous while also functioning as air delivery and diffusion means.

A specific object is to provide the foregoing air supply means embodying a plenum chamber that is superimposed on substantially the entirety of a room ceiling and communicates with the room space through numerous elongate air passageways provided in the ceiling thereacross.

A more specific object is to provide the foregoing air supply means wherein the plenum chamber encompasses support structure that provides the aforesaid air passageways.

Preferred air supply means for a controlled environment room encompassing a room space, in accordance with the invention, include a room ceiling surmounting the room space, a top closure disposed above the ceiling and spaced apart from the ceiling to form a plenum chamber therewith, and an array of steel joists extending between and adapted to support the ceiling and the closure, such joists each including a pair of spaced apart chords being components of the ceiling and adapted to support the ceiling, such chords defining between them elongate slots extending through the ceiling, the slots providing air passageways extending from the plenum chamber to the room space for conducting pressurized air from the plenum chamber to the room space.

BRIEF DESCRIPTION OF THE DRAWINGS

The drawings illustrate a preferred embodiment of the controlled environment room and air supply structure therefor of the invention. In the drawings, like elements are identified by like reference symbols in each of the views, and:

FIG. 3 is an enlarged fragmentary sectional and elevational view, with parts broken away, of air supply structure in the controlled environment room, taken substantially on line 3—3 of FIG. 2;

FIG. 4 is a similarly enlarged fragmentary sectional and elevational view of the air supply structure, taken substantially on line 4—4 of FIG. 3;

DESCRIPTION OF THE PREFERRED EMBODIMENT

Figure 1:
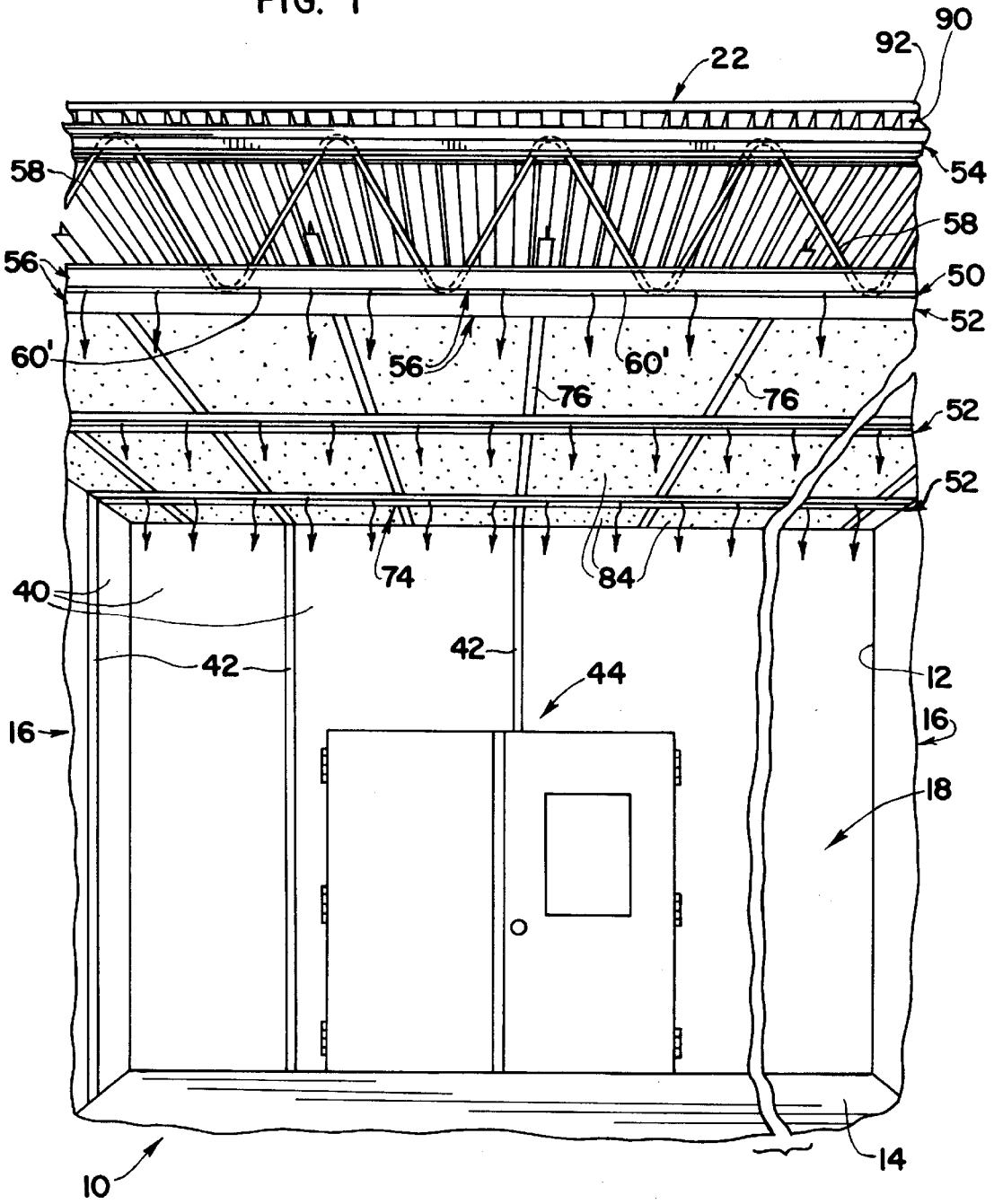
FIG. 1 is an internal perspective view of one end of a controlled environment room including air supply structure therefor, in accordance with the invention.

Referring to FIG. 1 of the drawings, a controlled environment or environmental room 10 encompasses a rectangular room space 12 bounded by a horizontal floor 14, vertical upstanding side and end walls 16 and 18, respectively, and a room ceiling 20. A top closure or roof 22 as erected or normally situated is disposed above the ceiling 20 and spaced apart therefrom to form a plenum chamber 24 defining or encompassing a plenum 26.

Figure 2:
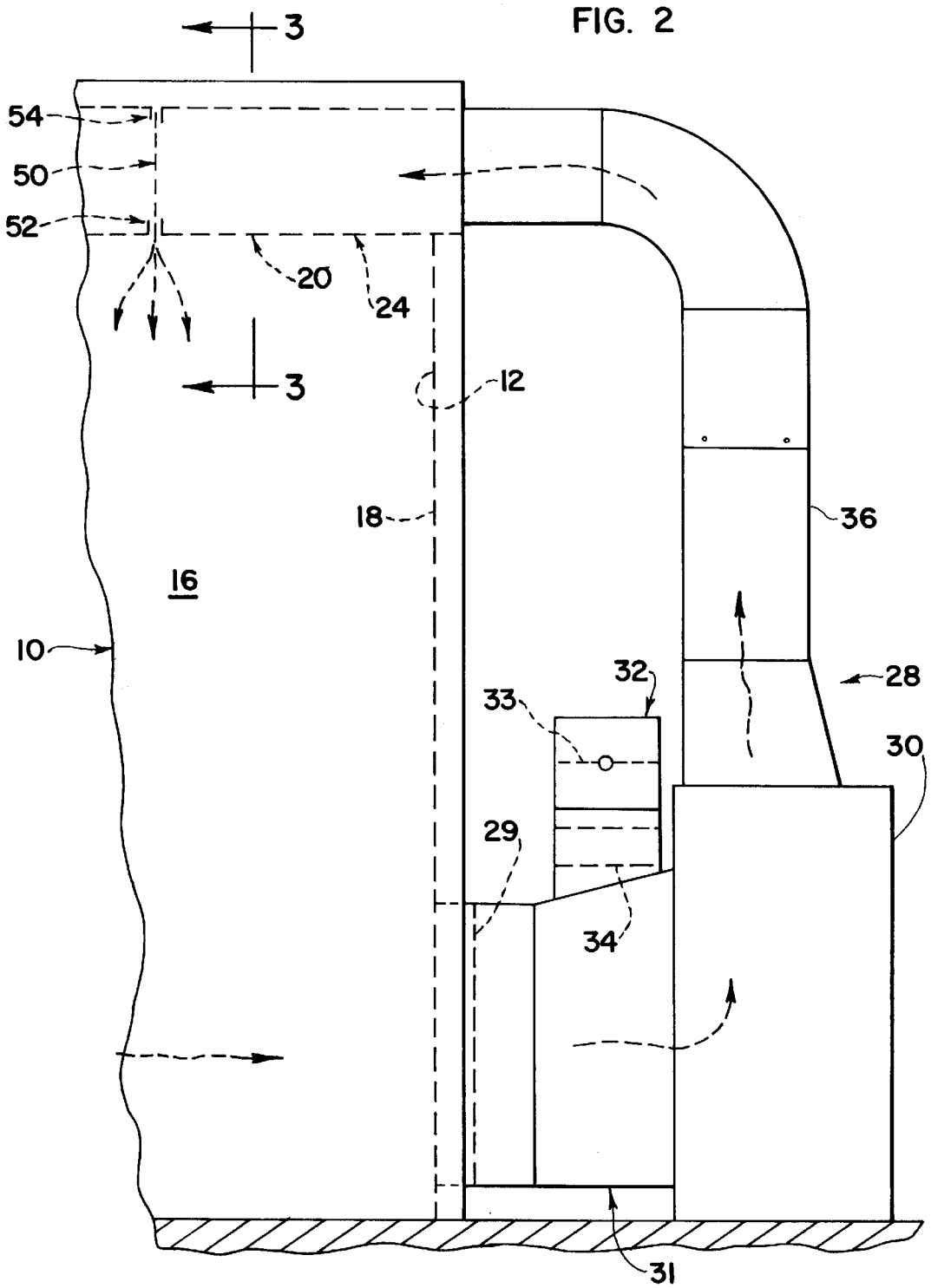
FIG. 2 is an external elevational view of one end of the room, schematically illustrating air treatment and recycling structure.

Referring to FIG. 2, air treatment and recycling structure 28 in the illustrative embodiment is externally connected to one end wall 18. The structure includes a room filter bank 29 mounted in the end wall 18 and an air conditioning or HVAC unit 30 connected to the outside of the room filter bank 29 by generally horizontal lower ductwork 31. Interposed between the room filter bank 29 and the air conditioning unit 30 is a makeup air supply unit 32, mounted on top of the lower ductwork 31 and communicating with the interior thereof. Makeup air as needed enters the top of the supply unit 32, as controlled by a damper 33 therein, under suction from the ductwork 31. The makeup air passes through a filter bank 34 in the unit 32, on its way to the ductwork 31. Upper ductwork 36 is connected to the top of the air conditioning unit 30 and extends upwardly therefrom to near the top of the room 10, where it is open to and communicates with the plenum 26 while connected to the plenum chamber 24.

The structure 28 described and illustrated in FIG. 2, for treating and recycling air from the room 12 to the plenum chamber 24 and supplying makeup air is generally conventional in its structure and air treatment components. Thus, the filter banks 29 and 34 are adapted to remove substantially all particles of 2 micron size and greater, for air supply to a powder coating room. The air conditioning unit 30 controls air temperature and humidity to maintain them in desired ranges, such as exemplified hereinabove. A blower in the unit serves to cycle the treated air and pressurize the air in the plenum chamber 24 and thereafter in the room space 12, so as to maintain a small positive or superatmospheric pressure in the room. The same or similar structure has been in use previously, in particular, for supplying treated air to ductwork installed above a ceiling, in turn supplying air to a plurality of diffusers mounted in the ceiling around the room. The illustrative structure 28 may be arranged and located in other ways, as may be desirable, while supplying treated air to the plenum chamber 24.

Referring to FIG. 1, the room 10 in the illustrative embodiment is constructed of a floor 14 that readily may be kept clean, and for that purpose is smooth and polished. Depending upon the construction of the manufacturing plant or other building in which the room is erected, the floor 14 may be specially finished to serve its purpose, while surrounding areas of the plant may remain in an unpolished condition. Thus, for example, the floor 14 may include a vinyl covering.

The room walls, such as the side and end walls 16 and 18, are constructed of upright rectangular wall panels 40 and vertical tubular load-bearing steel columns 42. In the illustrative embodiment, the panels 40 are mounted flush with the opposite faces of the columns 42. Alternatively, the panels 40 may be joined together to form walls on either side of the columns 42. A double door 44 provides access to the room space 12 in one end wall 18. Other means for access to the room 10, which are not illustrated, may include an overhead door accommodating a forklift truck, and a suitable conveyer opening or openings, as may be desired for a production conveyer line. The positive pressure maintained in the room space 24 prevents contamination of the room air by external or plant air at undesirable temperatures, humidities, and/or particle contents.

The foregoing construction, in general, may be conventional. The room 10 of the invention is characterized by its new and improved air supply means constituting a superstructure over the room space 12. The superstructure is made up of the room ceiling 20, the top closure 22, and an array of open web steel joists 50 that extend vertically between the ceiling and the closure. The components of this structure are connected together in a unit that is mounted on the tops of the columns 42, and encloses and seals the top of the room 10.

Referring also to FIGS. 3–6, the open web steel joists 50, also known as "bar joists", are illustrative of various joists having such designation, that are made commercially to standards prescribed by the Steel Joist Institute. They are constructed of top and bottom chords or chord sections, formed of steel bars, and a web formed of steel bars or bar sections. Joists are designed in accordance with Institute specifications as simply supported, uniformly loaded trusses supporting a floor or roof deck, so constructed as to brace the top chord(s) of the joists against lateral buckling. The original Warren truss type steel joist included a web formed from a single continuous bent bar of solid round cross section, having diagonal web bar sections, as in the illustrative joist 50. Modified Warren type web systems may include vertical as well as diagonal bar sections, as needed. Web sections or components may be provided in other ways.

The joists 50 are constructed of respective bottom and top pairs 52 and 54 of spaced apart parallel angle bar chords 56, which are adapted to support the ceiling 20 and the top closure 22, respectively. The joists also include round bar sections 58 that extend between the bottom and top chord pairs 52 and 54, and have their opposite ends received in the spaces 60 (see FIG. 5) existing between the chords 56 of respective pairs. The bar sections 58 are angularly related straight sections of a bent bar, and are integrally joined by return bends 62 in generally "V"-shaped configurations. Along with the ends of the bar sections 58, the bends 62 are disposed in the spaces 60 between adjacent chords 56. The bar sections 58 and bends 62 are rigidly connected to adjacent chords 56 by electric fillet welds 64.

The chords 56 are composed of elongate normally vertical or upstanding rectangular flanges 66, and normally horizontal rectangular flanges 68 integral and forming right angles with the vertical flanges 66. The horizontal flanges 68 of the bottom pair of chords 52 form the bottoms of the chords and extend laterally outwardly in opposite directions from the vertical flanges 66. In the top pair 54 of chords 56, the horizontal flanges 68 form the tops of the chords, and extend laterally outwardly in opposite directions from the vertical flanges 66, in the preferred embodiment. The bar sections 58 and bends 62 are welded to the vertical flanges 66 by the welds 64. While the steel joist 50 represents a preferred structure in the illustrative application, it will be understood that the parts may be arranged in other ways, differing and/or additional web bar sections may be employed, and other types of chords may be employed, while accomplishing the objects of the invention.

Referring to FIGS. 1 and 3, the joists 50 extend transversely for the width of the room 10, in an array of longitudinally spaced apart parallel joists. Likewise, the chords 56 extend transversely, substantially for the width of the room, with the vertical flanges 66 thereof in spaced apart parallel relation. The joists are mounted on top of the columns 42 in the side walls 16.

Referring to FIG. 3, for mounting purposes, angle iron supports 69 are rigidly connected to the chords 56 in the top pair 54, at opposite ends of each joist 50. The supports 69 have vertical flanges 70 connected to the outer surfaces of the vertical flanges 66 of the chords 56, as by welding, and horizontal flanges 71 extending laterally outwardly from the vertical support flanges 70, below the chords 56.

Mounting plates or caps 72 are rigidly connected to the tops of the columns 42, as by welding. Angle iron clips 73 are rigidly secured to the inner sides of the columns 42, as by welding. In mounting the joists 50 on the columns 42, the supports 69 are seated on the mounting plates 72 in load-bearing relationship. The horizontal support flanges 71 are rigidly connected to the mounting plates 72, as by welding and/or bolting, such as illustrated in FIG. 3 by a bolt and nut 72A. The chords 56 in the bottom pair 52 are connected to the clips 73, as by a bolt and nut 73A, for stabilizing purposes but in substantially non-load bearing relationship. The ceiling 20 thus is suspended from the top chord pairs 54.

Figure 5:
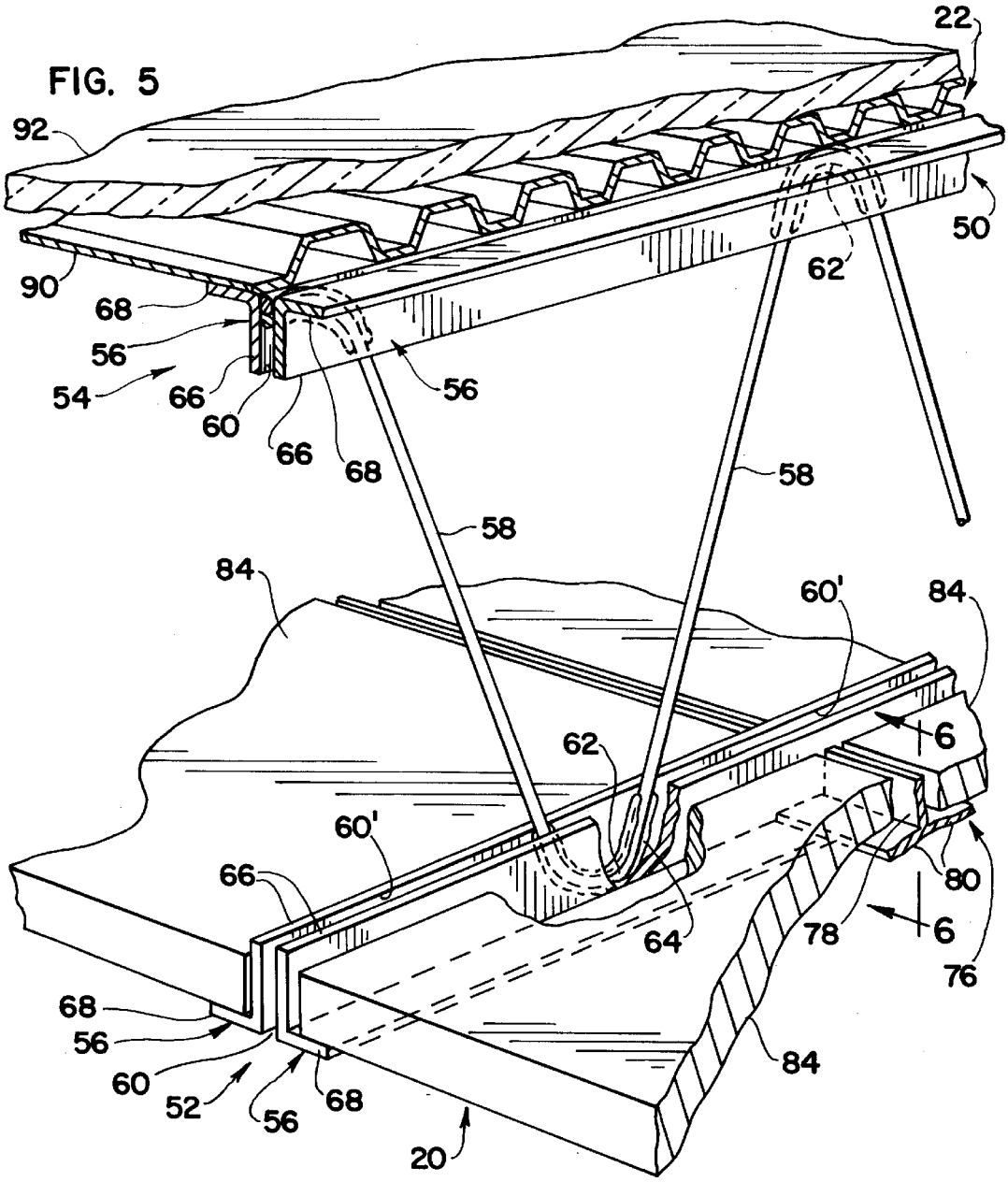
FIG. 5 is a further enlarged fragmentary perspective view of the air supply structure.
Figure 6:
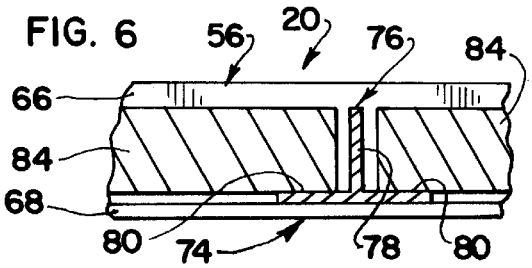
FIG. 6 is a still further enlarged fragmentary sectional and elevational view showing details of the structure, taken substantially on line 6—6 of FIG. 5.

Referring to FIGS. 1 and 5, in conjunction with FIGS. 4 and 6, the ceiling includes a grid, network, or lattice 74 composed of an array of longitudinally spaced apart parallel bottom pairs 52 of the chords 56, and an array of transversely or laterally spaced apart parallel, inverted-"T"-shaped runners 76. The runners 76 extend longitudinally in intersecting relation to the bottom chord pairs 52 and are fastened to the bottom chords 56. Each runner includes an elongate vertical or upstanding rectangular flange 78 and, integral therewith, two elongate horizontal rectangular flanges 80 extending laterally outwardly from the vertical flange 78 in opposite directions and at right angles thereto. The horizontal flanges 80 are at the bottom of the runners.

The ceiling 20 is completed by flat rectangular ceiling panels or pans 84 supported by the grid 74. Opposite side edges of the panels 84 are seated on the horizontal flanges 80 of the runners 76. Opposite end edges of the panels 84 are received by the chords 56 in the bottom pairs 52 and extend over the horizontal flanges 68 thereof. In this connection, the illustrative horizontal runner flanges 80 preferably are a maximum of about ⅛ inch thick, so that the end edges of the panels 84 for the most part rest on the horizontal chord flanges 68. The side edges of the panels may be cut away or relieved to receive the runner horizontal flanges 80 in recesses in the panels (not shown), thus seating the panels fully on both the runner flanges 80 and the chord flanges 68.

Figure 7:
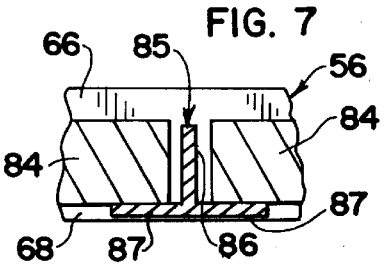
FIG. 7 is a view like FIG. 6 of an alternative arrangement of the parts.

In an alternative construction, illustrated in FIG. 7, runners 85 having vertical flanges 86 and horizontal flanges 87 may have the opposite ends of the horizontal flanges and of the vertical flanges cut away or recessed, so that the horizontal runner flanges 87 are level or coplanar with the horizontal chord flanges 68. The panels 84 then are supported in a continuous plane of the upper surfaces of the horizontal runner and chord flanges 87 and 68, respectively, as represented in FIG. 7. In any event, any air that might enter the room space 12 around the panels 84 would be insubstantial and may be disregarded.

As illustrated in FIGS. 1 and 3–5, the top closure 22 is mounted on the steel joists 50 and, together with a fascia 88 and accessory means, not shown, completes and closes the plenum chamber 24, and closes and seals the room 10. The closure 22 includes a deck 90 secured on top of the joists 50, and a cover 92 secured on top of the deck. The deck 90 preferably comprises corrugated steel sheet material, which is secured to the horizontal flanges 68 of the top chord pairs 54. The cover 92 preferably constitutes insulating material such as foam polystyrene having both sides covered and encased in aluminum foil. The fascia 88 closes the top of the room 10 above the columns 42 and the adjoining wall panels 40.

Referring particularly to FIG. 5, the spaces 60 between the chords 56 of the bottom chord pairs 52 in the joists 50 provide elongate slots 60' defined by the chords and extending through the ceiling 20. The slots 60' in the illustrative embodiment extend through the bottom chord pairs 52 on opposite sides of the bends 62, which periodically block the spaces 60 to the flow of air through the chord pairs. The slots 60' provide air passageways extending from the plenum chamber 24 to the room space 12 (see FIG. 1) of the controlled environment room 10, for conducting pressurized air from the plenum chamber in substantially laminar flow to the room space.

As represented by arrows in FIG. 1, air is supplied in relatively free flow from numerous areas of the ceiling 20, at both ends of each panel 84 and for a large part of the room width. As compared to the prior use of air diffusers, the air distribution is more even, and air is supplied to the room at a lower velocity. The air supply to the plenum chamber 24, illustrated in FIG. 2, requires merely a discharge from the ductwork 36 into the chamber 24, after which air flow encounters relatively low interference or pressure drop, as compared to the prior supply of air to a network of ducts connected to diffusers. It will be understood that while other equipment commonly mounted in the ceiling is not illustrated, such as lighting equipment, the same may be included in the plenum chamber 24 and the ceiling panels 84.

By way of example, the illustrative powder coating room 10 may have dimensions of approximately 80 feet in length, 40 feet in width, and 15 feet in ceiling height. A joist 50 having a depth of 2 feet may be employed. Ceiling panels 84 may measure 41 inches in width and 98 inches in length. However, such a room may vary widely in dimensions.

While a preferred embodiment of the invention has been described and illustrated, it will be apparent to those skilled in the art that various changes and modification may be made therein within the spirit and scope of the invention. It is intended that all such changes and modifications be included within the scope of the claims.

We claim:

1. In a controlled environment room encompassing a room space, air supply means which comprise:

a room ceiling surmounting said room space, a top closure disposed above said ceiling and spaced apart from the ceiling to form a plenum chamber therewith, and an array of horizontally spaced apart open web steel joists each extending vertically between and adapted to support said ceiling and said closure, said joists each including a bottom pair of spaced apart chords adapted to support said ceiling and a top chord adapted to support said top closure, web sections extending between and having their opposite ends disposed adjacent to said bottom chord pair and said top chord, respectively, and means rigidly connecting said web section ends to the bottom chord pair and the top chord adjacent thereto, said chords of said bottom pair comprising components of said ceiling and defining between them elongate slots extending through the ceiling, said slots providing air passageways extending from said plenum chamber to said room space for conducting pressurized air from the plenum chamber to the room space.

2. A controlled environment room as defined in claim 1 and wherein said chords of said bottom pair each comprise an angle bar having an elongate normally horizontal bottom flange adapted for receiving one end of a ceiling panel thereover.

3. In a controlled environment room encompassing a room space, air supply means which comprise:

a room ceiling surmounting said room space, a top closure disposed above said ceiling and spaced apart from the ceiling to form a plenum chamber therewith, and an array of horizontally spaced apart open web steel joists each extending vertically between and adapted to support said ceiling and said closure, said joists each including a bottom pair of spaced apart chords adapted to support said ceiling and a top pair of spaced apart chords adapted to support said top closure, web sections extending between said chord pairs and having their opposite ends received in the spaces between the chords of respective pairs, and means rigidly connecting said web section ends to the chords adjacent thereto, said chords of said bottom pair comprising components of said ceiling and defining between them elongate slots extending through the ceiling, said slots providing air passageways extending from said plenum chamber to said room space for conducting pressurized air from the plenum chamber to the room space.

4. A controlled environment room as defined in claim 3 and wherein said chords of said bottom pair each comprise an angle bar having an elongate normally horizontal bottom flange adapted for receiving one end of a ceiling panel thereover.

5. Air supply means for a controlled environment room encompassing a room space, which comprise:

a room ceiling adapted for surmounting said room space of a controlled environment room, a top closure normally disposed above said ceiling and spaced apart from the ceiling to form a plenum chamber therewith, and an array of horizontally spaced apart open web steel joists each extending vertically between and adapted to support said ceiling and said closure, said joists each including bottom and top pairs of spaced apart chords adapted to support said ceiling and said closure, respectively, web sections extending between said chord pairs and having their opposite ends received in the spaces existing between the chords of respective pairs, and means rigidly connecting said web section ends to the chords adjacent thereto, the chords of said bottom pair comprising components of said ceiling and defining between them elongate slots extending through the ceiling, said slots providing air passageways extending from said plenum chamber to said room space of a controlled environment room for conducting pressurized air from the plenum chamber to the room space.

6. Air supply means as defined in claim 5 and wherein the chords of said bottom pair each comprise an angle bar having an elongate normally horizontal bottom flange adapted for receiving one end of a ceiling panel thereover.

7. Air supply means as defined in claim 5 and including means for conducting preconditioned air to said plenum chamber.

8. Air supply means for a controlled environment room encompassing a room space, which comprise:

a room ceiling adapted for surmounting said room space of a controlled environment room and including a grid and ceiling panels supported by said grid;

a top closure normally disposed above said ceiling and spaced apart from the ceiling to form a plenum chamber therewith; and an array of horizontally spaced apart open web steel joists each extending vertically between and adapted to support said ceiling and said closure;

said joists each including bottom and top pairs of spaced apart angle bar chords adapted to support said ceiling and said closure, respectively, web sections extending between said chord pairs and having their opposite ends received in the spaces existing between the chords of respective pairs, and means rigidly connecting said web section ends to the chords adjacent thereto;

said bottom chord pairs comprising said grid and each chord thereof having an elongate normally horizontal bottom flange adapted for receiving one end of a ceiling panel thereover;

the chords of each of said bottom pairs defining between them elongate slots extending through said ceiling;

said slots providing air passageways extending from said plenum chamber to said room space of a controlled environment room for conducting pressurized air from the plenum chamber to the room space.

9. Air supply means as defined in claim 8 and including means for conducting preconditioned air to said plenum chamber.

* * * * *